US008348223B2

(12) United States Patent
Evans

(10) Patent No.: US 8,348,223 B2
(45) Date of Patent: Jan. 8, 2013

(54) FLEXIBLE MOLD FOR A SMOKING DEVICE

(76) Inventor: Douglas J. Evans, Boulder, CO (US)

( * ) Notice: Subject to any disclaimer, the term of this patent is extended or adjusted under 35 U.S.C. 154(b) by 67 days.

(21) Appl. No.: 12/833,531

(22) Filed: Jul. 9, 2010

(65) Prior Publication Data

US 2012/0006970 A1 Jan. 12, 2012

(51) Int. Cl.
*B28B 7/06* (2006.01)
*F25C 1/22* (2006.01)

(52) U.S. Cl. ..... 249/58; 249/127; 249/129; 249/144; 249/153; 249/157; 249/183; 425/DIG. 44; 220/501; 220/503; 220/505; 220/506; 220/555

(58) Field of Classification Search ..... 249/55, 249/58, 83, 117, 122, 127, 134, 144–147, 249/154, 157, 183, 184, 82, 129, 153; 220/501, 220/503–506, 555; 425/DIG. 44
See application file for complete search history.

(56) References Cited

U.S. PATENT DOCUMENTS

| | | | | | |
|---|---|---|---|---|---|
| 59,687 | A | * | 11/1866 | Waldstein et al. | 215/6 |
| 200,065 | A | * | 2/1878 | Kloczewski et al. | 215/6 |
| 555,410 | A | * | 2/1896 | Stevenson | 220/501 |
| 1,296,591 | A | * | 3/1919 | Bamberg | 148/439 |
| 2,683,298 | A | * | 7/1954 | Fadden | 249/186 |
| 3,163,910 | A | * | 1/1965 | Greene | 249/52 |
| 3,442,481 | A | * | 5/1969 | Di Stasio | 249/117 |
| 4,044,781 | A | * | 8/1977 | Heggestuen | 131/173 |
| 4,055,620 | A | * | 10/1977 | Conrad | 264/313 |
| 4,142,377 | A | | 3/1979 | Fogt | |
| 4,177,229 | A | * | 12/1979 | Moore | 264/40.5 |
| 4,206,899 | A | | 6/1980 | Whitehead | |
| 4,306,423 | A | | 12/1981 | Webb et al. | |
| 4,807,844 | A | * | 2/1989 | Tu | 249/78 |
| 5,085,230 | A | * | 2/1992 | Roman | 131/235.1 |
| 5,217,671 | A | * | 6/1993 | Moriuchi et al. | 264/313 |
| 5,250,315 | A | | 10/1993 | Loew et al. | |
| 5,971,352 | A | | 10/1999 | Kirks | |
| 6,726,051 | B1 | * | 4/2004 | Rennick | 220/576 |
| 6,989,168 | B2 | * | 1/2006 | Fahey | 426/120 |
| 7,014,162 | B2 | | 3/2006 | Lion et al. | |
| 2006/0191944 | A1 | * | 8/2006 | Starr et al. | 220/576 |
| 2006/0226334 | A1 | * | 10/2006 | Campbell | 249/134 |
| 2007/0267424 | A1 | * | 11/2007 | Marks | 220/703 |
| 2008/0283533 | A1 | * | 11/2008 | Tilton et al. | 220/506 |
| 2011/0005533 | A1 | * | 1/2011 | Evans | 131/191 |

FOREIGN PATENT DOCUMENTS

| | | | | |
|---|---|---|---|---|
| FR | 2597840 | A1 | * | 10/1987 |
| WO | WO 9306026 | A2 | * | 4/1993 |

* cited by examiner

*Primary Examiner* — Dimple Bodawala
(74) *Attorney, Agent, or Firm* — The Webb Law Firm

(57) ABSTRACT

A flexible mold for a smoking device having a cup-shaped outer wall, a cup-shaped inner wall, and a third cup-shaped wall. The outer wall has a continuous sidewall connected to a bottom wall containing a central opening. The sidewall of the outer wall extends from the bottom wall of the outer wall to an open end and contains an opening in the sidewall spaced between the bottom end and the open end. The inner wall has a continuous sidewall, a cover closing one end. The sidewall of the inner wall is attached to the bottom wall of the outer wall surrounding the central opening. The third wall has a continuous sidewall and a closed end. The sidewall of the third wall is connected to the sidewall of the outer wall surrounding the opening in the outer wall. The closed end abuts a surface of the inner wall.

17 Claims, 4 Drawing Sheets

FLEXIBLE MOLD FOR A SMOKING DEVICE

BACKGROUND OF THE INVENTION

1. Field of the Invention

The present invention relates, in general, to a flexible mold for a smoking device that may or may not utilize a liquid-phase cooling agent to cool the smoke, remove ash, and other contaminate matter before the smoke is inhaled by the user.

2. Description of Related Art

Various forms of smoking paraphernalia are known in the art. Generally, such devices are used to aid in smoking tobacco or tobacco-like substances, including medicinal herbs, and other organic material. Over time, numerous variations of pipes, hookahs, and narghiles have evolved. The use of a cooling agent, such as water or another suitable substance in a liquid state, in connection with smoking paraphernalia has been particularly popular because of the inherent benefits associated with passing the smoke through water before being inhaled by the user. The use of water in smoking paraphernalia is particularly desirable to both cool the smoke and remove ash and other particulate matter from the smoke.

In general, a conventional smoking apparatus comprises a containment vessel partially filled with water. The containment vessel comprises at least a first orifice for smoke intake and at least a second orifice for smoke discharge. A consumable smoking substance, such as tobacco or other smoking material, is placed inside a bowl comprised on the exterior portion of the containment vessel, wherein the bowl is in fluid connection with the first orifice. Generally, the amount of consumable smoking substance placed inside the bowl is only sufficient to fill the containment vessel with smoke. The containment vessel is filled with water. The user's mouth covers the second orifice, and by taking a deep breath, the air inside the containment vessel is displaced and smoke drawn through the first orifice permeates through the water and fills the containment vessel. The user then inhales the smoke through a series of puffs until all of the smoke inside the containment vessel is used. Optionally, a plurality of tubes may be connected to the first and second orifices for a more convenient use. Additionally, atmospheric air may be introduced into the containment vessel through an auxiliary orifice to dilute the smoke before inhalation. An additional benefit of the auxiliary orifice is to allow the user to control the velocity of the smoke and air mixture being inhaled.

Water pipes are ordinarily similar in construction to the above-described smoking apparatus, with the exception of a mouthpiece communicating with the second orifice. Using the mouthpiece, the user draws the smoke from the burning bowl through the water in the containment vessel. As the smoke bubbles through the water, it fills the containment vessel and is selectively inhaled by the user through the mouthpiece.

Despite the popularity of conventional smoking paraphernalia, there exist several disadvantages associated with such designs. Conventional containment vessels are often of unitary construction and may be difficult to maintain in a sanitary condition. This is particularly evident with containment vessels having complex geometric shapes whereby the physical form of the vessel prohibits cleaning out the sediment that may accumulate within the containment vessel. Furthermore, mouthpieces allow for accumulation of moisture and saliva which further compounds the unsanitary condition.

A further drawback of conventional water pipes is that the cooling medium becomes quickly contaminated with ash and other particulate matter and must be changed frequently. This problem can be alleviated by having multiple water pipes; however, due to their often intricate designs, such a solution may be cost prohibitive to many users. The prior art, therefore, lacks inexpensive and disposable smoking devices adapted for a single use.

An additional drawback of existing water pipes is that the smoke is not sufficiently cooled prior to being inhaled by the user. While the water cools the hot smoke to an extent, the cooling action may not be as thorough as many smokers desire. Water contained within the containment vessel is often at ambient temperature, and its cooling effect may not be substantial enough to produce a dense charge of smoke within the containment vessel. There exists a need in the art for a novel and improved smoking device wherein the smoking device retains the benefits of conventional smoking paraphernalia and further improves on its shortcomings.

Traditional pipes that do not use cooling liquid also suffer from many of the same disadvantages.

The present invention overcomes the foregoing and other deficiencies in the prior art by providing a novel and improved mold for a smoking device.

SUMMARY OF THE INVENTION

According to one aspect of the present invention, there is provided a mold for a smoking device where the molded product is a smoking device. The molding medium is generally any substance that is viscous enough to be introduced into the mold and substantially fill the mold and is adapted to transform in the mold to a solid or semi-solid state sufficiently rigid to be used as a smoking device upon removal from the mold. The molding medium is preferably water; however, wine, fruit juice, or other liquid substances having similar thermal properties to water could be alternately used. Alternately, the molding medium may comprise a material capable of changing phase from liquid to solid once exposed to a temperature change, such as freezing or heating. As a further alternative, the molding medium may comprise one or more liquid-phase constituents that solidify when combined. The molding medium is introduced into the mold which is subsequently exposed to a temperature change such that the molding medium transitions from a liquid state to a solid state. The molded smoking device is intended to be used as a water pipe to aid in smoking tobacco or tobacco-like substances. The molded smoking device preferably utilizes a liquid-phase cooling agent to cool the smoke and remove ash and other contaminate matter before the smoke is inhaled by the user.

The primary object of the present invention is to provide a flexible mold for a smoking device used for smoking tobacco or tobacco-like substances, including medicinal herbs, and other organic material. The flexible mold for a smoking device generally comprises a cup-shaped outer wall, a cup-shaped inner wall, and a third wall. The cup-shaped outer wall has a continuous sidewall connected to a bottom wall containing a central opening. The sidewall extends from the bottom wall to an open end and there is an opening in the sidewall spaced between the bottom wall and the open end. The cup-shaped inner wall has a continuous sidewall and a cover closing one end. The sidewall is attached to the bottom wall of the outer wall surrounding the central opening in the bottom wall. The inner wall is shorter than the outer wall, and there is a space between the outer wall and the inner wall. The connection of both the inner wall and the outer wall to the bottom wall of the outer wall forms an interior cavity which is filled with the molding medium. The third cup-shaped wall has a continuous sidewall and a closed end. The sidewall of the third cup-shaped wall is connected to the sidewall of the outer wall surrounding the opening in the outer wall. The closed end abuts a surface of the inner wall to create an orifice in the sidewall of the molded smoking device when it is removed from the mold.

According to a further aspect of the present invention, the mold for a smoking device enables for molding a smoking device that is economical to manufacture and easy to dispose. Because the molding medium is preferably water, the molded smoking device can be conveniently disposed of after use.

According to another aspect of the present invention, the mold for a smoking device enables for a smoking device that overcomes the sanitary shortcomings of conventional smoking paraphernalia. The molded smoking device is intended to be used for as long as it retains a solid composition at a given ambient temperature. The molded smoking device may be utilized indefinitely at ambient temperatures below the solidification point of the molding medium. Rather than cleaning the molded smoking device, the user may simply introduce the molded smoking device into an environment having a temperature higher than the melting point of the molding medium. The molded smoking device can thereby be disposed of in a safe and practical manner.

According to another aspect of the present invention, the smoke cooling and purification benefits of a water pipe are realized in the creation of a molded smoking device adapted to dispense measured quantities of cool, dense smoke for the user's benefit. The cooling benefits are increased because the molded smoking device itself further cools the liquid cooling medium. Being comprised of a frozen molding medium, the molded smoking device effectively removes heat from the liquid cooling medium and enables the user to benefit from a cooler and denser smoke charge.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification wherein like reference numerals designate corresponding parts in the various figures. It is to be expressly understood, however, that the drawings are for the purpose of illustration and description only and are not intended as a definition of the limits of the invention.

DESCRIPTION OF THE PREFERRED EMBODIMENTS

Figure 1:
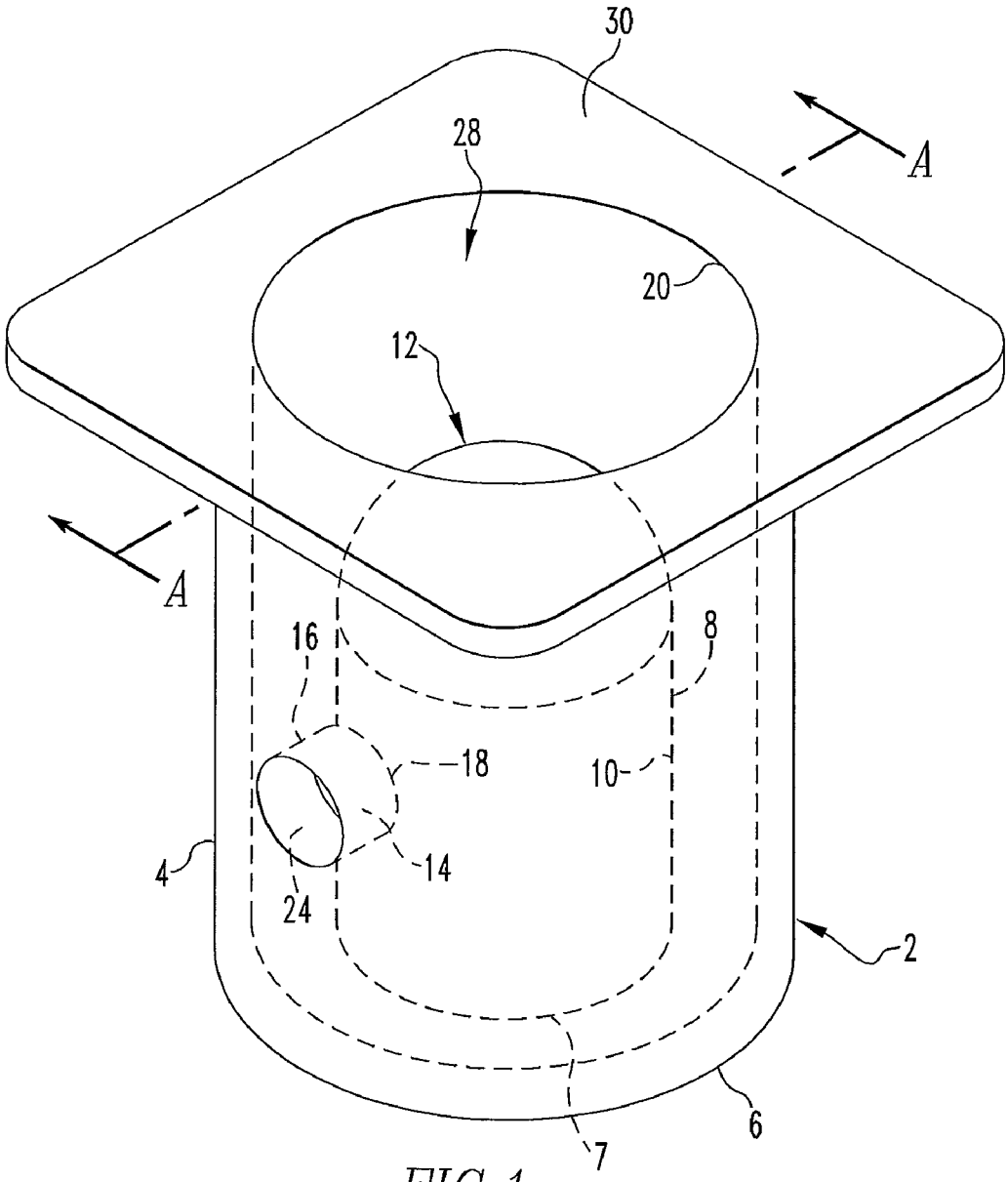
FIG. 1 shows a perspective view of the flexible mold according to a preferred embodiment of the present invention.

For purposes of the description hereinafter, spatial or directional terms shall relate to the present invention as it is oriented in the drawing figures. However, it is to be understood that the present invention may assume various alternative variations, except where expressly specified to the contrary. It is also to be understood that the specific components illustrated in the attached drawings, and described in the following specification, are simply exemplary embodiments of the present invention. Hence, specific dimensions and other physical characteristics related to the embodiments disclosed herein are not to be considered as limiting.

Figure 2:
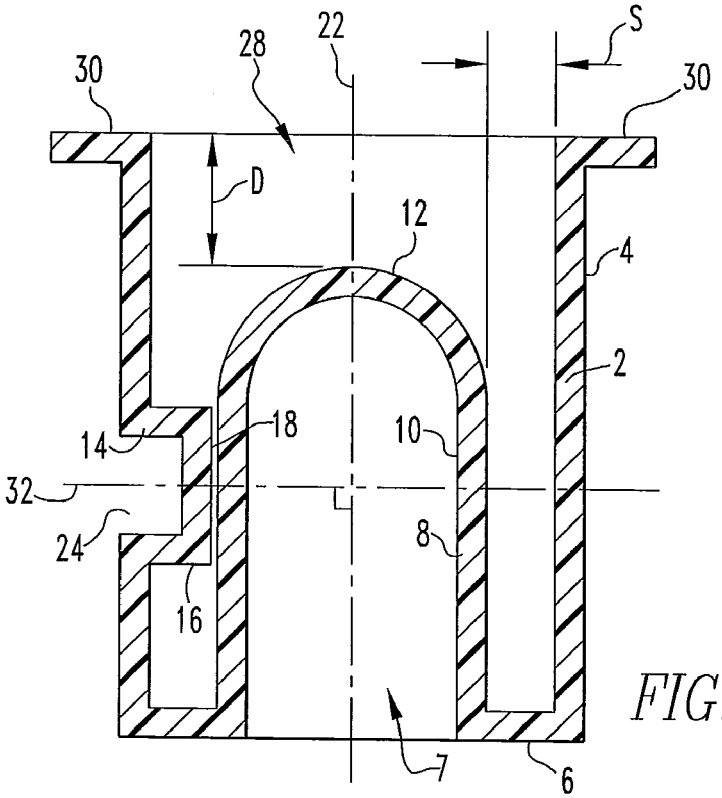
FIG. 2 shows a side, cross-sectional view of the flexible mold shown in FIG. 1 along line A-A.

As shown in FIGS. 1 and 2, a preferred embodiment of the smoking device mold generally comprises a cup-shaped outer wall 2 that has a continuous sidewall 4 and a bottom wall 6 with a central opening 7, a cup-shaped inner wall 8 with a continuous sidewall 10 and a cover 12 closing one end, and a third cup-shaped wall 14 with a continuous sidewall 16 and a closed end 18.

Figure 4:
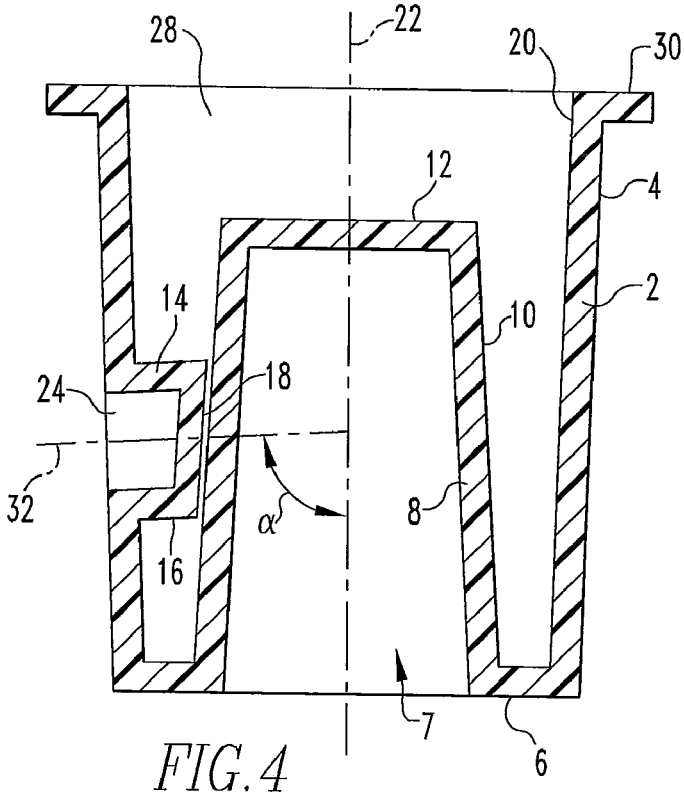
FIG. 4 shows a side, cross-sectional view of a flexible mold wherein both the inner cup-shaped wall and the outer cup-shaped wall are at an angle to the central axis of the mold and the cover of the inner wall is flat.

The cup-shaped outer wall 2 has a continuous sidewall 4 that is connected to a bottom wall 6 and extends from the bottom wall 6 to an open end 20. It may be parallel to the central axis of the mold 22 (see FIGS. 1 and 2) or may be at an angle to the central axis 22 (see FIG. 4) such that the cross-section of the outer wall 2 is smaller at the bottom wall 6 than at the open end 20. The outer wall 2 also contains at least one opening 7 spaced between the bottom wall 6 and the open end 20. The bottom wall 6 is generally flat and contains a central opening 24. The cross-section of the outer wall is preferably a circle but may take any shape including but not limited to an oval, a square, a rectangle, a triangle, and a polygon.

The inner wall 8 is cup-shaped with a continuous sidewall 10 and a cover 12 closing one end. The continuous sidewall 10 of the inner wall 8 is connected to the bottom wall 6 of the outer wall 2 surrounding the central opening 7. The cover 12 closing the inner wall 8 is spaced from the open end 20 of the outer wall 2 a distance (D) below the open end 20 of the outer wall 2 such that the inner wall 8 is shorter than the outer wall 2. This difference in height allows the molding medium to solidify to form a solid plane at the top of the mold which becomes the bottom of the smoking device when it is removed from the mold. The distance (D) should be of sufficient height to provide a bottom for the molded smoking device that is thick enough to contain the contents of the molded smoking device and will retain its integrity at ambient temperature long enough for the user to enjoy the use of the molded device. Preferably, the distance (D) is at least 0.25".

Figure 3:
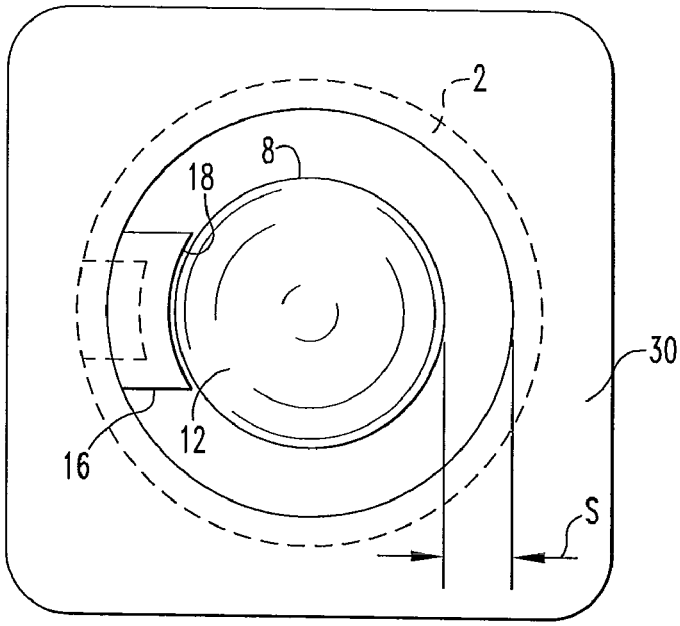
FIG. 3 shows a top view of the flexible mold shown in FIG. 1.

In addition, as shown in FIGS. 2 and 3, there is a space (S) between the inner wall 8 and the outer wall 2. This space (S) allows the molding medium to form a vertical wall upon solidification which becomes the sidewall of the molded smoking device when it is removed from the mold. The space (S) should be of sufficient width to provide a sidewall for the molded smoking device that is thick enough to contain the contents of the molded smoking device and will retain its integrity at ambient temperature long enough for the user to enjoy the use of the molded device. Since the sidewalls of both the inner wall 8 and the outer wall 2 can be angled with respect to the central axis of the mold 22, it should be recognized that the space (S) may vary in width from the bottom wall 6 to the open end 20. Preferably, the space (S) is at least 0.25" at its narrowest portion.

The shape of the inner wall determines the shape of the containment vessel of the molded smoking device. Therefore, while generally cup-shaped, it may take any shape suitable for a containment vessel in a smoking device. Thus, the cross-section of the inner wall, while preferably a circle, may take any shape including but not limited to an oval, a square, a rectangle, a triangle, and a polygon. The cover 12 may be convex (see FIG. 2), concave, or flat (see FIG. 4). The sidewall 10 of the inner wall 8 may be parallel to the central axis of the mold 22 or may be at an angle to the central axis 22 such that the cross-section of the inner wall 8 at its attachment to the bottom wall 6 of the outer wall 2 is larger than the cross-section of the covered end of the inner wall 8 (see FIG. 4).

The inner wall 8 and the outer wall 2 are connected to the bottom wall 6 of the outer wall 2 to form an interior cavity 28 which will be filled with the molding medium. The inner wall 8 and outer wall 2 may be made integral to the bottom wall 6 of the outer wall 2 using injection molding or another similar conventional technique or may be attached to the bottom wall 6 of the outer wall 2 by any suitable means including but not limited to gluing or thermal bonding.

A third cup-shaped wall 14 having a continuous sidewall 16 and a closed end 18 is connected to the sidewall 4 of the outer wall 2 surrounding the opening 24 in the outer wall 2. The third wall 14 extends perpendicularly from the sidewall 4 of outer wall 2. The third wall 14 is cylindrical and abuts against a surface of the inner wall 8. The term "abuts" means that at least one point or edge on the third wall 14 either directly contacts or is immediately adjacent to the inner wall 8. The purpose of the third wall 14 is to create an orifice in the sidewall of the molded smoking product so that a tubular member, such as a hose or a slide, may be inserted therethrough. The third wall 14 merely abuts the inner wall 8. It is not attached to the inner wall 8. The third wall 14 bends and pulls out of the hole that is created in the molded smoking device when the device is removed from the mold. The outer wall 2 may have more than one opening 24 provided with more than one additional wall.

While the third wall 14 described above is cylindrical and thus has a circular cross-section, its cross-section may be of any shape that will accommodate a tubular member including but not limited to an oval, a square, a rectangle, a triangle, and a polygon. Further, while it is described as hollow, it may be solid as long as it is flexible enough to allow removal of the molded smoking device from the mold after solidification.

Figure 5:
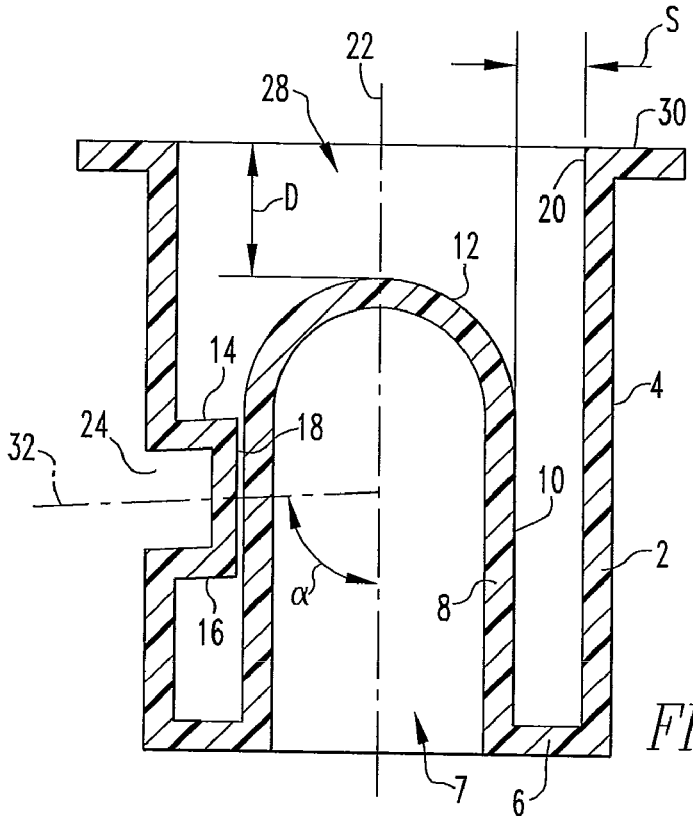
FIG. 5 shows a side, cross-sectional view of the flexible mold shown in FIG. 1 along line A-A modified by placing the third cup-shaped wall at an angle.

The third wall 14 may alternatively be placed with its central axis 32 at an angle $\alpha$ to the central axis of the mold 22 as shown in FIG. 5. The angular orientation of the third wall 14 is such that the closed end 18 of the third wall 14 is oriented toward the open end 20 of the outer wall 2. Preferably, the central axis of the third wall 32 is at a 70° angle to the central axis of the mold 22 with respect to the bottom wall 6 of the outer wall 2.

The third wall 8 may be made integral to the outer wall 2 using injection molding or another similar conventional technique or may be attached to the outer wall 2 by any suitable means including but not limited to gluing or thermal bonding.

The outer wall 2 may further comprise a plurality of indicia (not shown) disposed on the interior and/or exterior of the outer wall 2. For example, the sidewall 4 of the outer wall 2 may have at least one maximum fill line to indicate the maximum amount of a liquid molding medium which may be poured into the interior cavity 28. The maximum fill line is positioned such that once the mold is filled with a molding medium, a sufficient gap between the maximum fill line and the open end 20 of the outer wall 2 exists to accommodate for expansion of the molding medium as it changes state from liquid to solid.

The outer wall 2 may also extend perpendicularly away from the open end 20 of the outer wall 2 to form a flange 30 to aid in moving the mold when it is filled with molding medium and to aid in removal of the molded smoking device from the mold.

Figure 6:
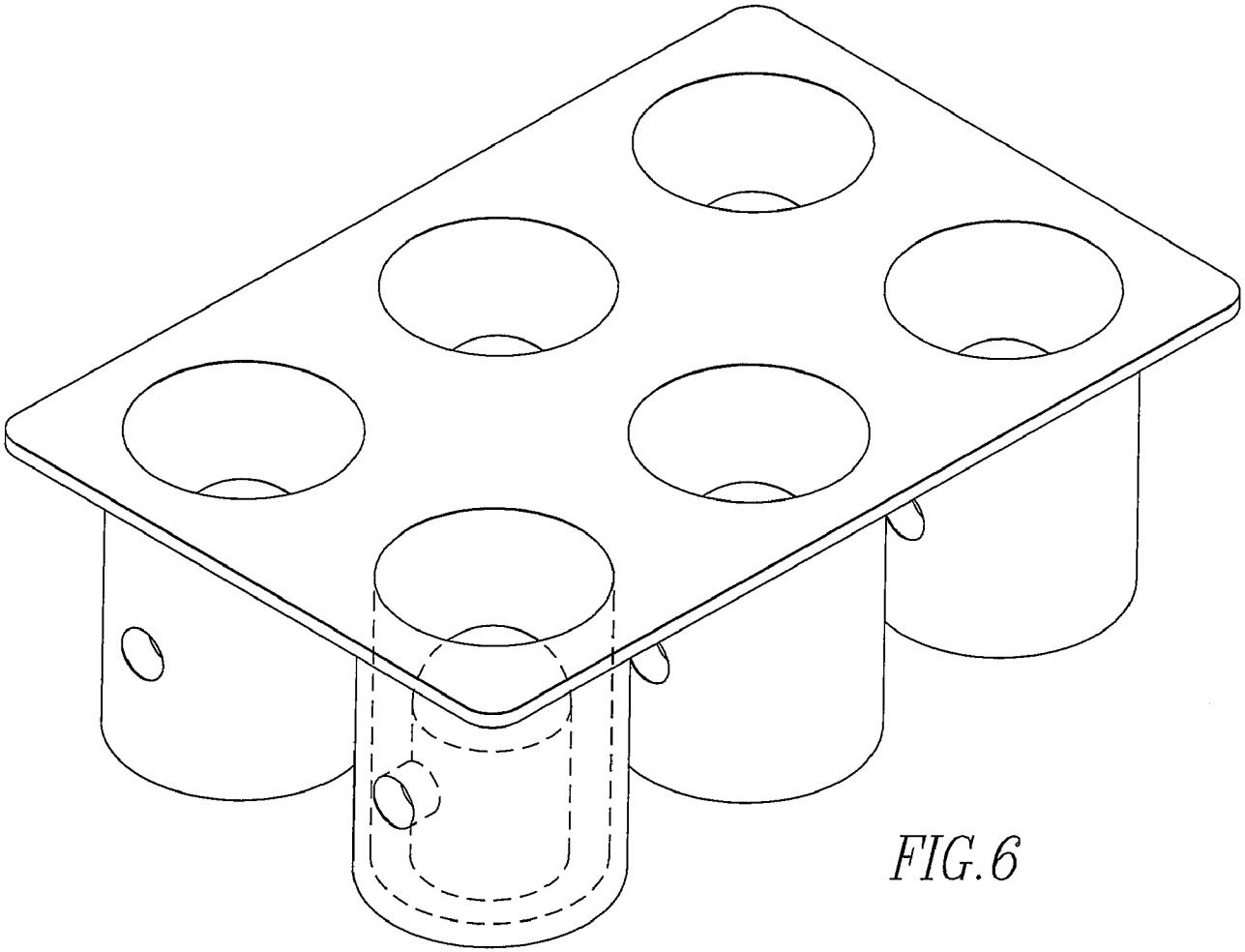
FIG. 6 shows a perspective view of multiple flexible molds according to the invention connected to form a tray.

In another embodiment, the flanges 30 of a plurality of molds may be connected together in a grid to form a tray for molding multiple smoking devices as shown in FIG. 6.

The smoking device mold is preferably manufactured from a resilient, flexible material having stable properties of thermal expansion. Because the smoking device mold will be subjected to large temperature differences, it must not be prone to breaking or cracking at extreme temperatures, including the freezing point of water. The mold may be manufactured from any suitable flexible material including but not limited to plastic, rubber, or foam. As a further alternative, the mold may be manufactured using any combination of flexible materials. Additionally, the material may be translucent or opaque. Preferably, the mold is manufactured from silicone rubber, polystyrene, or polyethylene to allow easy removal of the molded smoking device from the mold. It is contemplated that the selection of a suitable material for the mold is within the expertise of one of ordinary skill in the art. The present disclosure is not intended to limit the mold material to a specific type described herein but is rather used for describing a single preferred embodiment. Furthermore, it is desired that the mold is manufactured from a material meeting the necessary health and safety specifications required for human use and contact.

The smoking device mold, or at least the portions coming into contact with the molding medium, has a low coefficient of friction such that the molded smoking device may be easily removed therefrom. Alternately, the portions of the mold that come into contact with the molding medium may be coated with a material having a low coefficient of friction, such as polytetraflouroethylene, commonly known under the trademark TEFLON®.

In use, the interior cavity 28 of the mold is filled with a molding medium that is viscous enough to be introduced into the mold and substantially fill the mold and is adapted to transform in the mold to a solid or semi-solid state sufficiently rigid to be used as a smoking device upon removal from the mold. While liquid water is defined as the preferred molding medium, one of ordinary skill in the art will appreciate that wine, fruit juice, or other equally acceptable liquid-molding media may be utilized. Alternately, the molding medium may comprise a material capable of changing phase from liquid to solid once exposed to a temperature change, such as freezing or heating. As a further alternative, the molding medium may comprise one or more liquid-phase constituents that solidify when combined. As yet another alternative, the molding medium may comprise a substance capable of changing phase from liquid to solid after undergoing a chemical reaction. The chemical reaction may be assisted by a catalyst or induced by a temperature change. One of ordinary skill in the art will appreciate that a plurality of different molding media may be utilized with the mold without changing the scope of the present invention.

The interior of the mold is filled with a molding medium. The mold is placed in a suitable environment to allow the molding medium to change phase from liquid to solid, e.g., a conventional freezer when the molding medium is water. Any potential expansion of the molding medium is preferably alleviated by filling the mold up to the maximum fill line.

Once the molding medium has solidified, the mold may be removed from the environment. It may be desirable to leave the mold at ambient temperature for a short period of time in order to facilitate removal of the molded smoking device from the mold. Alternately, the mold may be exposed to a temperature change, such as by heating or cooling the mold or submerging it in ambient temperature water, in order to facilitate removal of the molded smoking device. The molded smoking device may then be removed from the mold and utilized for the user's benefit of smoking tobacco or tobacco-like substances.

While the discussion of the flexible mold provided herein has mainly focused on a smoking device that uses a cooling agent, it should be understood that the inventive flexible mold may also be used to produce smoking devices that are used to directly smoke tobacco or tobacco-like substances without the use of a cooling agent.

While specific embodiments of the present invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A flexible mold for casting a smoking device, said mold comprising:

an outer cup-shaped wall having a continuous sidewall connected to a generally flat bottom wall, said bottom wall having a central opening therein, said continuous sidewall extending from the bottom wall to an open end and said continuous sidewall having an opening extending therethrough spaced between the bottom wall and the open end;

an inner cup-shaped wall comprising a continuous sidewall and a cover closing one end of the continuous sidewall, said continuous sidewall connected to the bottom wall of the outer cup-shaped wall surrounding the central opening in the bottom wall, said cover closing one end of the continuous sidewall of the inner cup-shaped wall being spaced from the open end of the outer cup-shaped wall; and a third cup-shaped wall having a continuous sidewall and a closed end, said continuous sidewall connected to the continuous sidewall of the outer cup-shaped wall surrounding the opening in the continuous sidewall of the outer cup-shaped wall, and said closed end abutting a surface of said inner cup-shaped wall.

2. The flexible mold of claim 1, wherein the continuous sidewall of the inner cup-shaped wall is at an angle with respect to a central axis of the mold.

3. The flexible mold of claim 1, wherein the continuous sidewall of the outer cup-shaped wall is at an angle with respect to the central axis of the mold.

4. The flexible mold of claim 1, wherein both the continuous sidewalls of the outer cup-shaped wall and the inner cup-shaped wall are at an angle with respect to the central axis of the mold.

5. The flexible mold of claim 1, wherein the cover of the inner cup-shaped wall is flat.

6. The flexible mold of claim 1, wherein the cover of the inner cup-shaped wall is curved.

7. The flexible mold of claim 1, wherein the outer cup-shaped wall has a cross-section that is a circle, an oval, a square, a rectangle, a triangle, or a polygon.

8. The flexible mold of claim 1, wherein the inner cup-shaped wall has a cross-section that is a circle, an oval, a square, a rectangle, a triangle, or a polygon.

9. The flexible mold of claim 1, made from plastic, rubber, or foam.

10. The flexible mold of claim 1, made from silicone rubber, polystyrene, or polyethylene.

11. The flexible mold of claim 1, wherein the third cup-shaped wall is perpendicular to the outer cup-shaped wall.

12. The flexible mold of claim 1, wherein the third cup-shaped wall is hollow.

13. The flexible mold of claim 1, wherein the third cup-shaped wall is solid.

14. The flexible mold of claim 1, wherein the third cup-shaped wall is at an angle with respect to the central axis of the mold.

15. The flexible mold of claim 14, wherein a central axis of the third cup-shaped wall forms a 70° angle with the central axis of the mold such that the closed end of the third cup-shaped wall is oriented towards the open end of the outer cup-shaped wall.

16. The flexible mold of claim 1, wherein the continuous sidewall of the outer cup-shaped wall extends perpendicularly away from the open end of the outer cup-shaped wall to form a flange at the open end of the outer cup-shaped wall.

17. The flexible mold of claim 16, wherein the flanges of a plurality of molds are connected in a grid to form a tray for molding multiple smoking devices.

* * * * *